United States Patent [19]

Teichert et al.

[11] 4,054,859

[45] Oct. 18, 1977

[54] FLAME PROBE

[75] Inventors: Allen L. Teichert, Placentia; Richard E. Jones, Los Alamitos, both of Calif.

[73] Assignee: Robertshaw Controls Company, Richmond, Va.

[21] Appl. No.: 700,663

[22] Filed: June 28, 1976

[51] Int. Cl.[2] ..... H01H 37/36

[52] U.S. Cl. ..... 337/309; 236/99 E; 337/326

[58] Field of Search ..... 337/298, 306, 309, 317, 337/326; 236/99 E; 73/368.2; 219/513

[56] References Cited

U.S. PATENT DOCUMENTS 2,834,854 5/1958 Stiebel et al. ..... 337/317

3,435,682 4/1969 Linke et al. ..... 73/368.2

FOREIGN PATENT DOCUMENTS 450,494 8/1948 Canada ..... 337/326

*Primary Examiner*—William H. Beha, Jr.

*Attorney, Agent, or Firm*—Fulwider, Patton, Rieber, Lee & Utecht

[57] ABSTRACT

A flame probe for use in an automatic pilot ignition system includes both a thermally responsive flame switch and a sensing electrode located in the flame for use in a flame conductivity sensing circuit. Separate conductive paths are provided for the flame switch and for connection to the sensing electrode and the conductive paths are completely insulated from each other.

17 Claims, 3 Drawing Figures

FLAME PROBE

BACKGROUND OF THE INVENTION

1. Field of the Invention

The present invention relates to a flame probe for use in an automatic pilot burner ignition system for a gas fueled heating system. In such systems it is necessary to sense the ignition of the pilot burner flame before the main burner of the system is lit and so that the ignition circuitry can be disabled. Sensing of the pilot burner can be accomplished in a variety of ways, but is typically accomplished either by sensing the heat of the pilot flame or by providing a sensing electrode in the path of the flame and sensing the increase in electrical conductivity between the electrode and the pilot burner body which is indicative of a flame. It has been proposed to construct an automatic pilot ignition system in which the flame is to be redundantly sensed. That is, the system would sense both the heat of the flame and the conductivity of the flame to thus sense the flame through two diverse characteristics of the flame. Such a system is disclosed is a co-pending patent application Automatic Fuel Ignition System with Redundant Flame Sensing by Allen L. Teichert and William E. Chambers. The flame probe of the present invention is particularly suited for use in such a system.

DESCRIPTION OF THE PRIOR ART

The prior art is well provided with examples of flame switches, which are typically thermally responsive switches which have their thermally responsive element located in or near the pilot flame so that the switch will close in response to flame ignition. The prior art is also generally cognizant of the principle of flame sensing through sensing of the increased conductivity and the pilot burner body which is caused by the flame. U.S. Pat. No. 3,806,305; 3,902,839; and 3,938,937 are examples of systems using this principle.

SUMMARY OF THE INVENTION

The present invention is summarized in that a flame probe includes a tubular electrode, a thermally responsive motive device at least partially contained within the tubular electrode, first, second, and third terminals, a first conductive path electrically connecting the first terminal to the electrode, and a second conductive path electrically connecting the second terminal to the third terminal in response to the operation of the thermally responsive motive device, the first and second conductive paths being electrically insulated from each other.

It is an object of the present invention to provide a flame probe which includes both a switch closed in response to the heat of the flame and a sensing electrode in the path of the flame.

It is another object of the present invention is to provide such a flame probe in which the switch closed in response to the heat of the flame is at all points insulated from the conductive path connecting to the sensing electrode.

It is an advantage of the present invention that it allows automatic pilot ignition systems to be made safer with little increase in cost in that two diverse types of flame sensing can be accomplished by a single probe.

Other objects, features and advantages of the present invention will become apparent from the following specification when taken in conjunction with the accompanying drawings.

Figure 1:
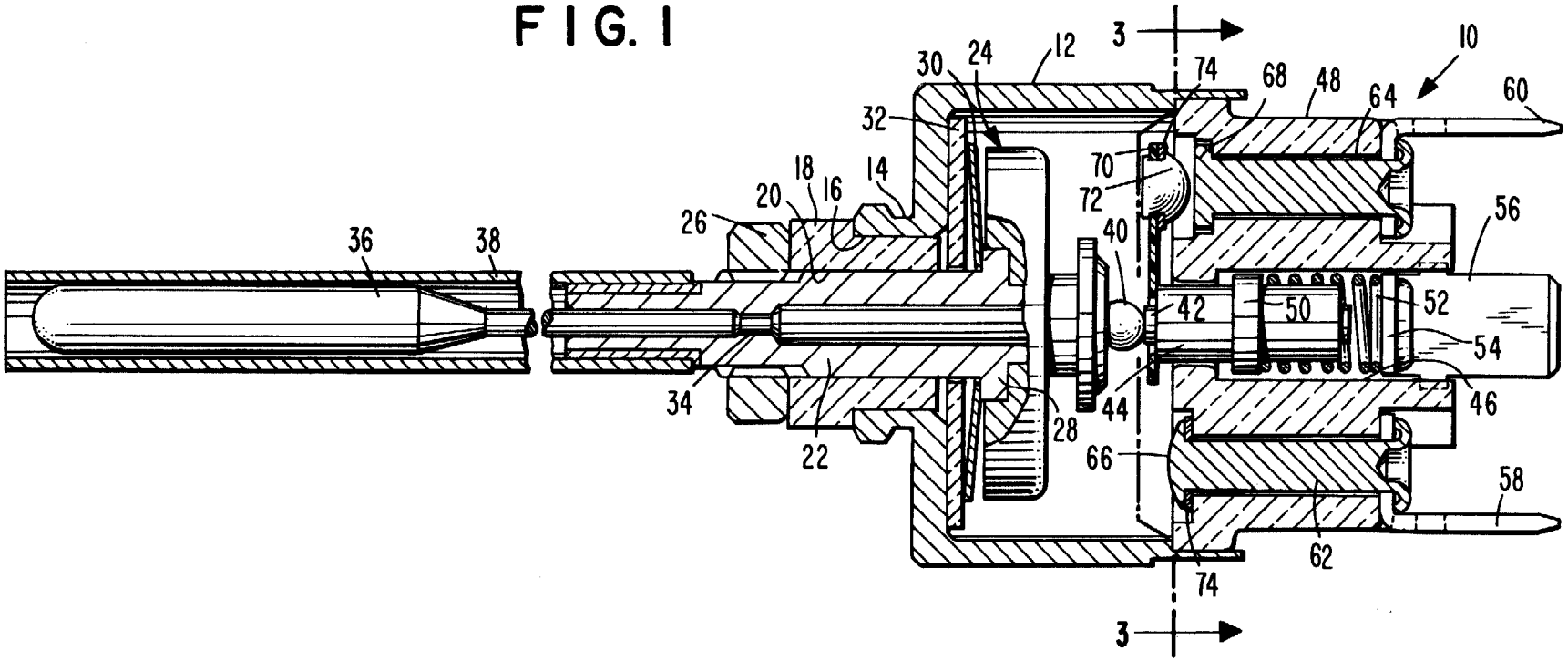
FIG. 1 is a side sectional view of a flame probe constructed according to the present invention.
Figure 2:
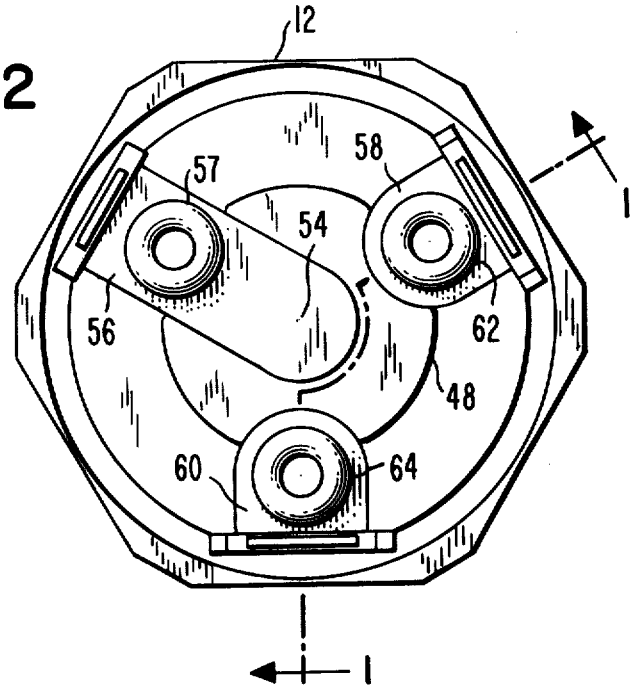
FIG. 2 is a end elevation view of the flame probe of FIG. 1.
Figure 3:
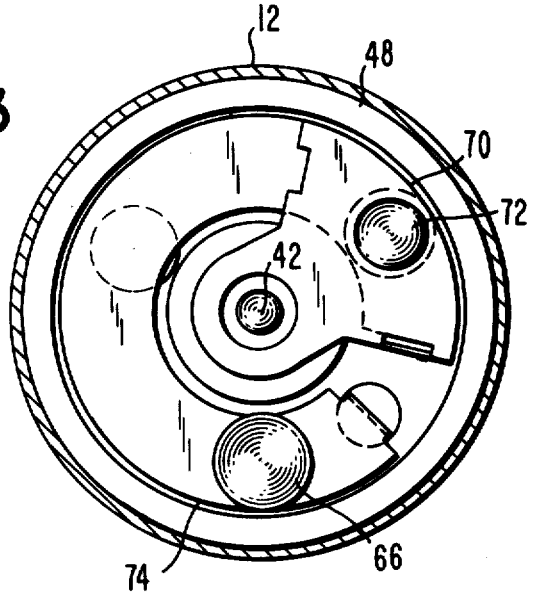
FIG. 3 is a cross sectional view along the line 3—3 of FIG. 1.

Shown in FIGS. 1-3 is a flame probe, indicated generally at 10, constructed according to the present invention. The flame probe 10 includes a main body 12 which is generally cylindrical with one closed and one open end, and has provided on its exterior a hexagonal surface so that it can be manipulated with a wrench or similar tool. A neck portion 14 extends from the closed end of the body 12 and has a cylindrical bore 16 formed through it, the bore 16 also extending through the closed end of the body 12 into the inside of the body 12. A tubular insulator 18 is received inside the bore 16 within the neck portion 14 and extends outward therefrom. The tubular insulator 18 has a longitudinal bore 20 provided completely through it in turn. Received inside the bore 20 in the insulator 18 is a body member 22 of a thermally responsive motive device, here a fluid charged diastat, generally indicated at 24. The diastat body member 22, which is formed of a conductive material, extends through the bore 20 and has at its outer end a threaded portion upon which is threaded a nut 26. Inside the body 12 the diastat body member 22 has an annular retainer 28 formed on it. The retainer 28 holds a disc shaped spring washer 30 between it and an insulator disc 32 which is pressed against the inside of the closed end of the body 12. The diastat 24 is thus held in place by the spring washer 30 which keeps the nut 26 pressed against the tubular insulator 18. Extending from the end of the diastat body member 22 outside of the body 12 is a sensing capillary tube 34 which terminates in a sensing bulb 36. At its other end, inside the body 12, the diastat 24 is provided with a spherical diastat contact 40. The diastat 24 is charged with a fluid which is thermally expansive, the fluid filling the sensing bulb 36, the capillary tube 34, and the inside of the diastat body member 22 such that if the sensing bulb 36 is heated, the fluid expands and the diastat contact 40 is moved to the right, as viewed in FIG. 1. The tube 34 and the bulb 36 are received within a conductive tubular electrode 38 which is fixed at its end to the diastat body member 22. The flame probe 10 is positioned when in use relative to the pilot burner flame so that the flame impinges on the tubular electrode 38 in the area of the bulb 36.

The diastat contact 40 rests in abutment with a movable contact 42 mounted on a conductive contact cylinder 44. The contact cylinder 44 travels within a longitudinal hollow 46 formed in the center of an insulating base 48 secured to the open end of the body 12. A retaining band 50 is formed on the contact cylinder 44, and the retaining band 50 retains one end of a conductive helical spring 52 which encirles the end of the contact cylinder 44. The other end of the helical spring 52 rests against a retaining tab 54 of a terminal 56 which is secured to the insulating base 48 by a rivet 57. The terminal 56 has a portion extending from the periphery of the insulating base 48 toward its center to end in the reataining tab 54, as can be seen in FIG. 2, and a portion extending outward from the end of the insulating base 12, as can be seen in FIG. 1. Similarly terminals 58 and 60 extend from the end of the insulating base 48, and are secured to the base by rivets 62 and 64. As shown in FIG. 1, the rivets 62 and 64 extend through the insulating base 48 and have stationary switch contacts 66 and 68 formed on their interior ends.

Secured to the end of the contact cylinder 44 around the movable contact 42 is an insulating switch operator arm 70. As can be best seen in the cross-sectional view of FIG. 3, the operator arm 70 is fan shaped, extending outward from the center of the probe, where it secures to the contact cylinder 44, to the periphery of the insulating base 48. The operator arm 70 is oriented in its mounting on the contact cylinder 44 so that the wide outer part of the arm is over the switch contact 68. Directly adjacent the switch contact 68, the operator arm 70 has mounted on it a movable switch contact 72, riveted through a hole in the operator arm 70. The movable switch contact 72 is also secured through a hole near one end of a spring conductor 74 and is thereby secured thereto. The spring conductor 74 is formed as a section of an annular conductive spirng and is secured near its opposite ends to both the movable switch contact 72 and the switch contact 66. The spring conductor 74 is biased to tend to pull the movable switch contact 74 toward the switch contact 68. The spring conductor 74 is staked at its one extreme end onto the arm 70 and at its outer extreme end to the insulating base 48.

In its operation the flame probe 10 of FIGS. 1–3 accomplishes two separate and diverse flame sensing functions. First, at all times a conductive path is maintained between the terminal 56 and the tubular electrode 38 so that a suitable flame conductivity sensing circuit can be connected to the terminal 56 and therethrough sense any increased conductivity between the tubular electrode 38 and the grounded body of the pilot burner which would indicate the presence of of a flame. Secondly, the flame probe 10 will cause a conductive path to be created between the terminals 58 and 60 only when the presence of a flame is sensed through the thermal energy released by the flame. The conductive paths used for each of these functions is kept electrically insulated from the other at all times.

The diastat 24 is, as was explained, charged with a fluid which will expand greatly when heated by the pilot burner flame. The expansion of that fluid caused by the heat of a flame on the bulb 36 will cause the diastat 24 to expand longitudinally, moving the diastat contact 40 to the right as it is viewed in FIG. 1. The contact cylinder 44 is biased by spring 52 so that the contact cylinder 44 follows the movement of the diastat contact 40, keeping the movable contact 42 in abutment against the diastat contact 40 at all times. This maintains a conductive path from the terminal 56 through the retaining tab 54, the helical spring 52, the contact cylinder 44, the movable contact 42 to the diastat contact 40 and therethrough to the diastat body member 22 and the tubular electrode 38. Thus a continuous conductive path will continually be maintained between the terminal 56 and the tubular electrode 38 regardless of any movement of the diastat contact 40. This conductive path is insulated from the terminals 58 and 60 and is also insulated from the body 12 which can be used as the ground or reference.

Any movement of the diastat contact 40 thus results in corresponding movement of the contact cylinder 44. The movement of the contact cylinder 44 is followed by the operator arm 70 because it is secured thereto. Movement of the operator arm 70 is, of course, followed by the movable switch contact 72. Therefore when the diastat contact 40 moves to the right, as viewed in FIG. 1, the movable switch contact 72 is brought into contact with the switch contact 68. Secure electrical contact between the two is ensured because of the bias provided by the spring conductor 74. When the diastat contact 40 retreats, the helical spring 52 force the contact cylinder 44 and the operator arm 70 to follow the retreat of the diastat to force the movable switch contact 72 away from the contact 68. When the contacts 72 and 68 are touching, a conductive path is completed from the terminal 58 through the rivet 62 and the spring conductor 74 to the movable switch contact 72 and from the switch contact 68 through the rivet 64 to the terminal 60. This conductive path is responsive to the movement of the diastat contact 40, and is therefore temperature dependent, closing only when the bulb 36 is heated by a pilot burner flame. And, of course, this conductive path is completely insulated from the path between the terminal 56 and the tubular electrode 38.

Thus the flame probe 10 of FIGS. 1–3 provides means for redundant flame sensing in a single probe. One circuit path maintains contact between the tubular electrode 38 and the terminal 56 at all times while the other circuit connects the terminal 58 to the terminal 60 only when flame temperature is sensed. Thus an economy is achieved inasmuch as a system using these two diverse types of flame sensing need only utilize this one probe.

It should also be recognized that a thermally responsive motive device other than a fluid filled diastat could be used within the scope of the present invention. Any temperature responsive motive device capable of fitting within a tubular electrode and capable of expansion against the force of a spring would be equally acceptable within the spirit of the present invention, as long as the device did not interfere with the conductive path between the tubular electrode and a suitable external terminal.

It is further within the scope of the present invention that the single-pole, single-throw switch of the conductive path between the terminals 58 and 60 could be made a double throw switch, as by providing an additional contact to contact the movable switch contact 72 in its retracted position, or could be made a double throw switch with an additional spring conductor 74 and set of contacts 72 and 68. Such a configuration may be advantageous if it is deemed desirable to connect the electronic flame conductivity sensing in series with the thermal flame switch contacts.

Inasmuch as the present invention is subject to many variations, modifications and changes in detail, it is intended that all the material in the foregoing specification or in the accompanying drawings be interpreted as illustrative, and not in a limiting sense.

What is claimed is:

1. A flame probe comprising a tubular electrode, a thermally responsive motive device at least partially contained within the tubular electrode, first, second and third terminals, a first conductive path electrically connecting the first terminal to the electrode, and a second conductive path electrically connecting the second terminal to the third terminal in response to the operation of the thermally responsive motive device, the first and second conductive paths being electrically insulated from each other.

2. A flame probe as claimed in claim 1 wherein the first conductive path inlcudes the thermally responsive motive device.

3. A flame probe as claimed in claim 2 wherein a first contact is provided on the thermally responsive motive device and a movable second contact is provided to maintain the first conductive path by following the movement of the first contact.

4. A flame probe as claimed in claim 3 wherein a spring biases the second contact toward the first contact.

5. A flame probe as claimed in claim 4 wherein the flame probe includes a hollow and a contact cylinder is received in the hollow, the second contact being mounted on the contact cylinder and the spring biasing the contact cylinder toward the first contact.

6. A flame probe as claimed in claim 5 wherein a retaining tab on the first terminal retains one end of the spring so that it biases the contact cylinder.

7. A flame probe as claimed in claim 6 wherein the first conductive path includes the retaining tab, the spring and the contact cylinder.

8. A flame probe as claimed in claim 2 wherein the flame probe includes a body and the thermally responsive motive device is insulated from the body.

9. A flame probe as claimed in claim 2 wherein the thermally responsive motive device is a fluid-filled diastat.

10. A flame probe as claimed in claim 1 wherein an operator arm follows the movement of the thermally responsive motive device and wherein the second conductive path includes a stationary switch contact and a movable switch contact, the movable switch contact being carried on the operator arm.

11. A flame probe as claimed in claim 10 wherein the thermally responsive motive device is in the first conductive path and wherein the operator arm is an insulator.

12. A flame probe as claimed in claim 10 wherein a spring conductor biases the movable switch contact toward the stationary switch contact.

13. A flame probe as claimed in claim 12 wherein the spring conductor is part of the second conductive path.

14. A flame probe comprising a thermally responsive motive device, a tubular electrode mounted on the thermally responsive motive device, electrical conductive means connecting to the tubular electrode through the thermally responsive motive means, a pair of switch contacts, and insulating operator means transmitting the movement of the thermally responsive motive device to the pair of switch contacts to operate the switch contacts in response to the movement of the thermally responsive motive device.

15. A flame probe as claimed in claim 14 wherein the electrical conductive means includes a movable contact cylinder biased to follow movement of the thermally responsive motive device and wherein the insulating operator means is mounted on the contact cylinder.

16. A flame probe as claimed in claim 15 wherein a spring conductor biases one of the switch contacts toward the other.

17. A flame probe as claimed in claim 16 wherein one of the switch contacts is mounted on the insulating operator means.

* * * * *